US008087927B2

(12) United States Patent
Aronson, II et al.

(10) Patent No.: US 8,087,927 B2
(45) Date of Patent: Jan. 3, 2012

(54) TORCH HAVING A CONTINUOUS-FLAME MODE

(75) Inventors: Louis V. Aronson, II, Oldwick, NJ (US); Adam Grabicki, Parsippany, NJ (US)

(73) Assignee: Zippo Manufacturing Company, Bradford, PA (US)

( * ) Notice: Subject to any disclaimer, the term of this patent is extended or adjusted under 35 U.S.C. 154(b) by 428 days.

(21) Appl. No.: 11/605,194

(22) Filed: Nov. 27, 2006

(65) Prior Publication Data

US 2008/0124665 A1 May 29, 2008

(51) Int. Cl.
*F23D 11/36* (2006.01)
*F23D 14/28* (2006.01)
*F23Q 7/12* (2006.01)

(52) U.S. Cl. ..... 431/153; 431/255; 431/344

(58) Field of Classification Search ..... 431/153
See application file for complete search history.

(56) References Cited

U.S. PATENT DOCUMENTS 1,159,015 A 11/1915 Gibbs
1,509,671 A 9/1924 Fish et al.
2,032,695 A * 3/1936 Gimera et al. ..... 431/151
2,631,891 A 3/1953 Kochner et al.
3,155,140 A * 11/1964 Wilson ..... 431/153
3,220,459 A * 11/1965 Wilson ..... 431/255
3,556,703 A * 1/1971 Florjancic ..... 431/273
3,694,134 A * 9/1972 Ross ..... 431/255
3,799,447 A 3/1974 Beal
4,025,000 A * 5/1977 Blasnik ..... 239/459
4,457,699 A * 7/1984 Hattori ..... 431/344
4,909,443 A 3/1990 Takagi et al.
5,090,893 A * 2/1992 Floriot ..... 431/153
5,183,322 A 2/1993 Haruch
5,407,346 A * 4/1995 Sher ..... 431/153
5,505,614 A * 4/1996 Lin ..... 431/143
5,558,514 A * 9/1996 Ansquer ..... 431/153
5,584,681 A * 12/1996 Suzuki ..... 431/132
5,660,333 A 8/1997 Strahman et al.
5,741,128 A * 4/1998 Tsai ..... 431/255
5,788,474 A * 8/1998 Chung et al. ..... 431/153
5,788,476 A * 8/1998 Sher ..... 431/153
5,833,145 A 11/1998 Smith
5,967,768 A * 10/1999 Saito et al. ..... 431/153
6,102,689 A * 8/2000 Man ..... 431/153
6,173,911 B1 1/2001 Hui-Chen et al.
6,196,833 B1 * 3/2001 Ho ..... 431/153
6,260,774 B1 * 7/2001 Erickson ..... 239/526

(Continued)

OTHER PUBLICATIONS

International Search Report and Written Opinion, PCT/US07/24484.

(Continued)

*Primary Examiner* — Steven B McAllister
*Assistant Examiner* — Frances H Kamps
(74) *Attorney, Agent, or Firm* — Metz Lewis Brodman Must O'Keefe LLC; Barry I. Friedman

(57) ABSTRACT

A hand-held torch includes a housing. A fuel flow path is defined within the housing. A plunger is movable within the housing to control fuel flow through the fuel flow path. An engagement portion is coupled to the plunger. A latching element is movable to engage the engagement portion when the plunger is positioned to allow fuel flow through the fuel flow path. An actuator is coupled to the latching element and exposed for manipulation by a user to move the latching element into engagement with the engagement portion.

33 Claims, 6 Drawing Sheets

U.S. PATENT DOCUMENTS

| | | | | |
|---|---|---|---|---|
| 6,293,782 | B1 | 9/2001 | Tsai et al. | |
| 6,296,476 | B1 * | 10/2001 | Tsai | 431/153 |
| 6,352,212 | B1 | 3/2002 | Wang et al. | |
| 6,425,538 | B1 | 7/2002 | Heren | |
| 6,527,543 | B2 * | 3/2003 | Tsai | 431/153 |
| 6,527,546 | B1 * | 3/2003 | Laforest et al. | 431/255 |
| 6,685,110 | B2 | 2/2004 | Wang et al. | |
| 6,688,879 | B2 * | 2/2004 | Tsai | 431/153 |
| 6,719,219 | B1 | 4/2004 | Wang et al. | |
| 6,746,234 | B2 * | 6/2004 | Laforest et al. | 431/153 |
| 6,758,413 | B1 | 7/2004 | Chen et al. | |
| 6,959,742 | B2 * | 11/2005 | Aronson et al. | 141/383 |
| 7,025,291 | B2 | 4/2006 | Wu et al. | |
| 7,025,588 | B2 * | 4/2006 | Laforest et al. | 431/153 |
| 7,131,558 | B2 * | 11/2006 | de la Guardia | 222/209 |
| 7,322,534 | B2 * | 1/2008 | Bartsch et al. | 239/310 |
| 7,455,082 | B2 * | 11/2008 | Monzel | 141/18 |
| 7,527,496 | B2 * | 5/2009 | Lin | 431/344 |
| 7,708,554 | B2 * | 5/2010 | Tsai | 431/153 |
| 2003/0203331 | A1 | 10/2003 | Hsu | |
| 2004/0149350 | A1 | 8/2004 | Aronson et al. | |
| 2005/0205692 | A1 * | 9/2005 | Edamura | 239/526 |
| 2006/0049283 | A1 | 3/2006 | Lee | |
| 2006/0260712 | A1 * | 11/2006 | Davis | 141/206 |

OTHER PUBLICATIONS

U.S. Appl. No. 11/974,194.

* cited by examiner

TORCH HAVING A CONTINUOUS-FLAME MODE

FIELD OF THE INVENTION

The present invention relates to a torch and, more particularly, to a torch with a continuous-flame mode.

BACKGROUND OF THE INVENTION

Known torches include hand-held, flame producing products that operate on fuel, incorporate an ignition mechanism and are used by consumers to ignite a variety of items. Some torches include a continuous-flame operating mode.

For example, U.S. Pat. No. 6,196,833, the disclosure of which is incorporated herein by reference, discloses a fuel burner that has a trigger, a safety switch, a protrusion rod extended through the safety switch and a positioning pin that can be pressed to keep the burner in a flame-spouting state. To initially establish a flame, the safety switch and the protrusion rod are manipulated and the trigger is pulled. Once a flame has been established, the positioning pin can be pressed to engage the trigger and thereby keep the burner in a flame-spouting state.

Improvements are desirable in the field of torches having a continuous-flame operating mode.

SUMMARY OF THE INVENTION

In one aspect, a hand-held torch includes a housing. A fuel flow path is defined within the housing. A plunger is movable within the housing to control fuel flow through the fuel flow path. An engagement portion is coupled to the plunger. A latching element is movable to engage the engagement portion when the plunger is in a position allowing fuel flow through the fuel flow path. A continuous-flame mode actuator is coupled to the latching element and exposed for manipulation by a user to move the latching element into engagement with the engagement portion.

In a typical embodiment, the latching element engaging the engagement portion prevents the plunger from moving into a position to block the fuel flow path.

According to another aspect, a hand-held torch includes a housing. A fuel flow path is defined within the housing. A plunger is movable within the housing to control fuel flow through the fuel flow path. An engagement portion is coupled to the plunger. A child-resistant actuator is adapted for manipulation by a user to move the plunger. A latching element is movable to engage the engagement portion when the plunger is in a position allowing fuel flow through the fuel flow path. A continuous-flame mode actuator is exposed for manipulation by a user to cause the latching element to engage the engagement portion.

In yet another aspect, a method of operating a hand-held, continuous-flame mode torch includes moving a plunger in the torch to an open position to establish fuel flow through a fuel flow path in the torch. The flowing fuel is ignited to create a flame at an outlet of the fuel flow path. With the plunger in the open position, a latching mechanism engages an engagement portion on the plunger to maintain fuel flow through the fuel flow path.

According to yet another aspect, a hand-held torch includes a housing, a fuel flow path defined in the housing, a flow control means for controlling fuel flow through the fuel flow path, a latching means for engaging the flow control means and a continuous-flame actuator means for moving the latching means into engagement with the flow control means whereby said flow control means provides continuous flow of said fuel through said fuel flow path.

In general, a torch is disclosed that is simple to operate. The torch can optionally include provisions for child-resistant operation.

DETAILED DESCRIPTION

In describing the preferred embodiments of the present invention, specific terminology will be resorted to for the sake of clarity. However, the invention is not intended to be limited to the specific terms so selected, and is understood that each specific term includes all technical equivalents which operate in a similar manner to accomplish the same purpose.

Figure 1:
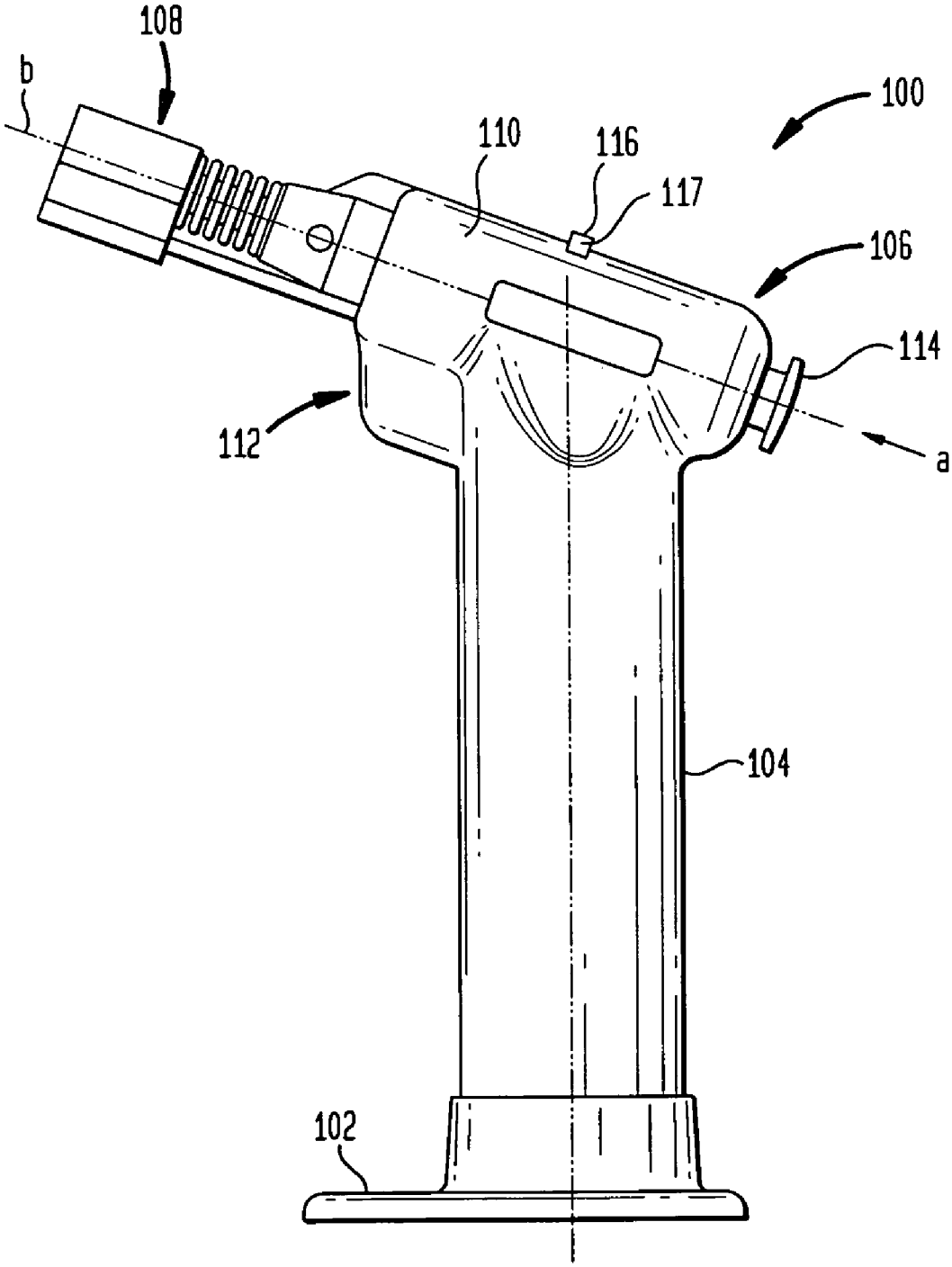
FIG. 1 is a side view of a hand-held torch that is capable of being operated in a continuous-flame mode.

Referring now to the drawings, wherein like reference numerals represent like elements, FIG. 1 is a hand-held torch 100 that is capable of being operated in a continuous-flame mode in accordance with one embodiment of the present invention.

The illustrated torch 100 includes a base 102, a handle 104 coupled to the base 102 and a torch assembly 106 contained within a housing 110 which is coupled to the handle 104. In the preferred embodiment, the handle 104 includes a fuel storage compartment operatively contained therein to supply fuel to the torch assembly 106. In other embodiments, however, the torch 100 is adapted to be coupled to a remotely-located fuel supply. One convenient fuel for the hand-held torch 100 is butane. In general, the torch assembly 106 is operable to deliver fuel from the fuel storage compartment, to ignite the fuel and to produce a flame at its nozzle 108.

A trigger 112 and a continuous-flame mode button 114 are coupled to the housing 110 and are operatively exposed for manipulation by a user. In one embodiment, successful manipulation of the trigger 112 results in the production of a flame at the nozzle 108. In those embodiments, manipulating the trigger 112 initiates fuel flow and ignites the flowing fuel. In some embodiments, the trigger 112 is spring-loaded in a manner that makes its operation child-resistant. More particularly, in those embodiments, the force required to overcome the spring-loading resists successful operation of the trigger 112 by young children.

In the preferred embodiment of the torch 100, the torch 100 can be operated in a continuous-flame mode. In this regard, if the button 114 is manipulated (i.e., pressed in the direction indicated by arrow "a" and then released while a flame is being produced), the torch 100 enters the continuous-flame mode. Once continuous-flame mode has been established, only releasing the trigger 112 will not cause the flame to extinguish. If the torch 100 is operating in the continuous-flame mode, that mode can be deactivated by manipulating (i.e., pressing and releasing) the button 114 again. In some embodiments, deactivating the continuous-flame mode requires pressing the button 114 deeper than is required to activate the continuous-flame mode.

Continuous-flame mode is an operational mode, in which the torch 100 can maintain a flame at the nozzle 108 as long as fuel is available, even if the trigger 112 is released. Activating the continuous-flame mode might be desirable in applications, such as soldering, where it is helpful to have a flame available for an extended period of time. It may be desirable to activate the continuous-flame mode in a variety of other applications, as well.

The illustrated torch 100 also includes an (optional) flame adjuster 116 coupled to the housing 110 and operatively exposed for manipulation by a user. Manipulation of the flame adjuster 116 affects the intensity of the flame that is produced at the nozzle 108. In the illustrated embodiment, the flame adjuster 116 includes a lever 117 that is adapted for movement back and forth within a slot in the housing 110. Moving the lever 117 in one direction increases the flame's intensity, while moving the lever 117 in the opposite direction decreases the flame's intensity. The flame adjuster 116 controls the rate at which fuel can flow to the nozzle 108 when the torch 100 is producing a flame.

Figure 2A:
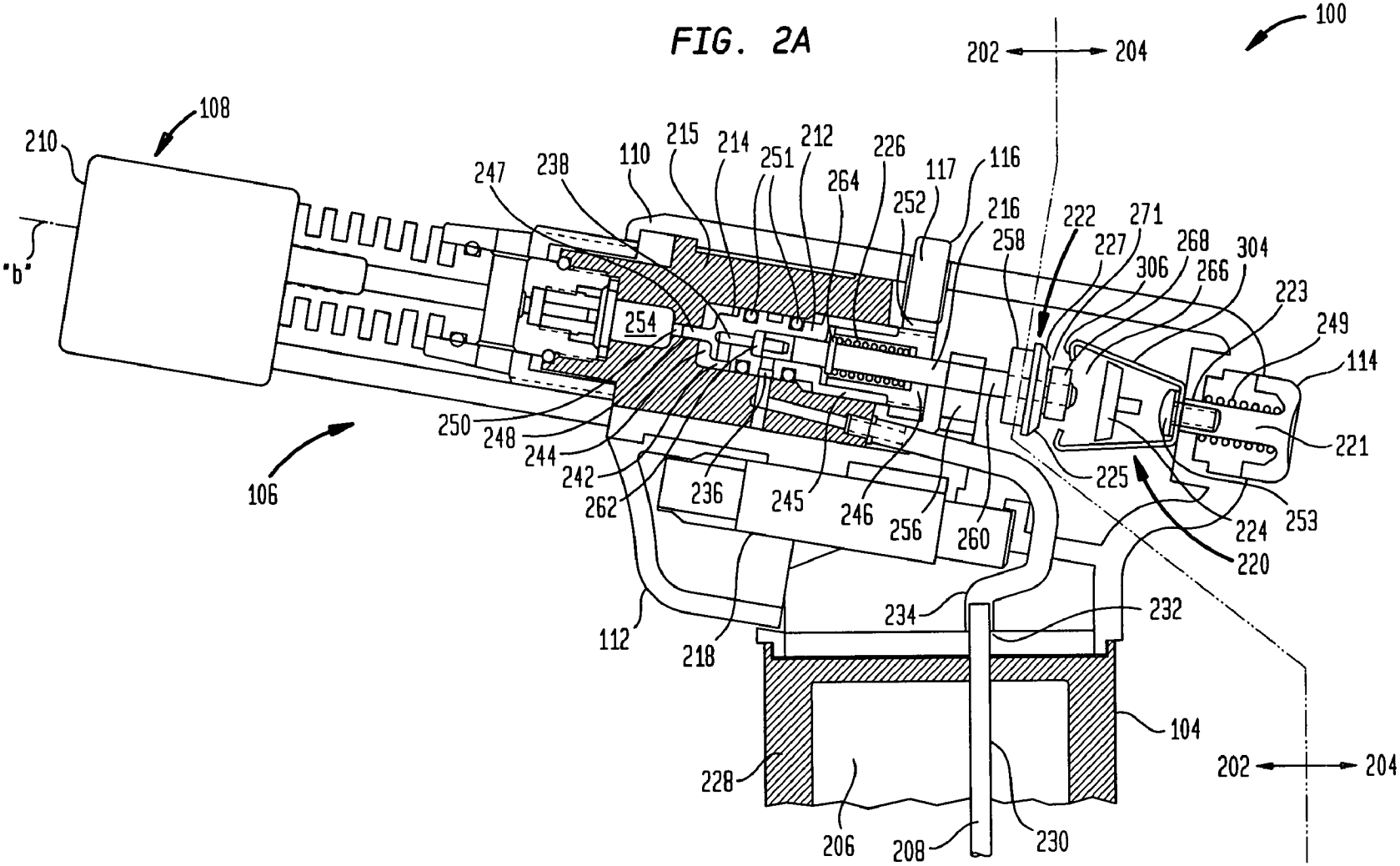
FIGS. 2A and 2B are cutaway partial side-views of the torch shown in FIG. 1.
Figure 2B:
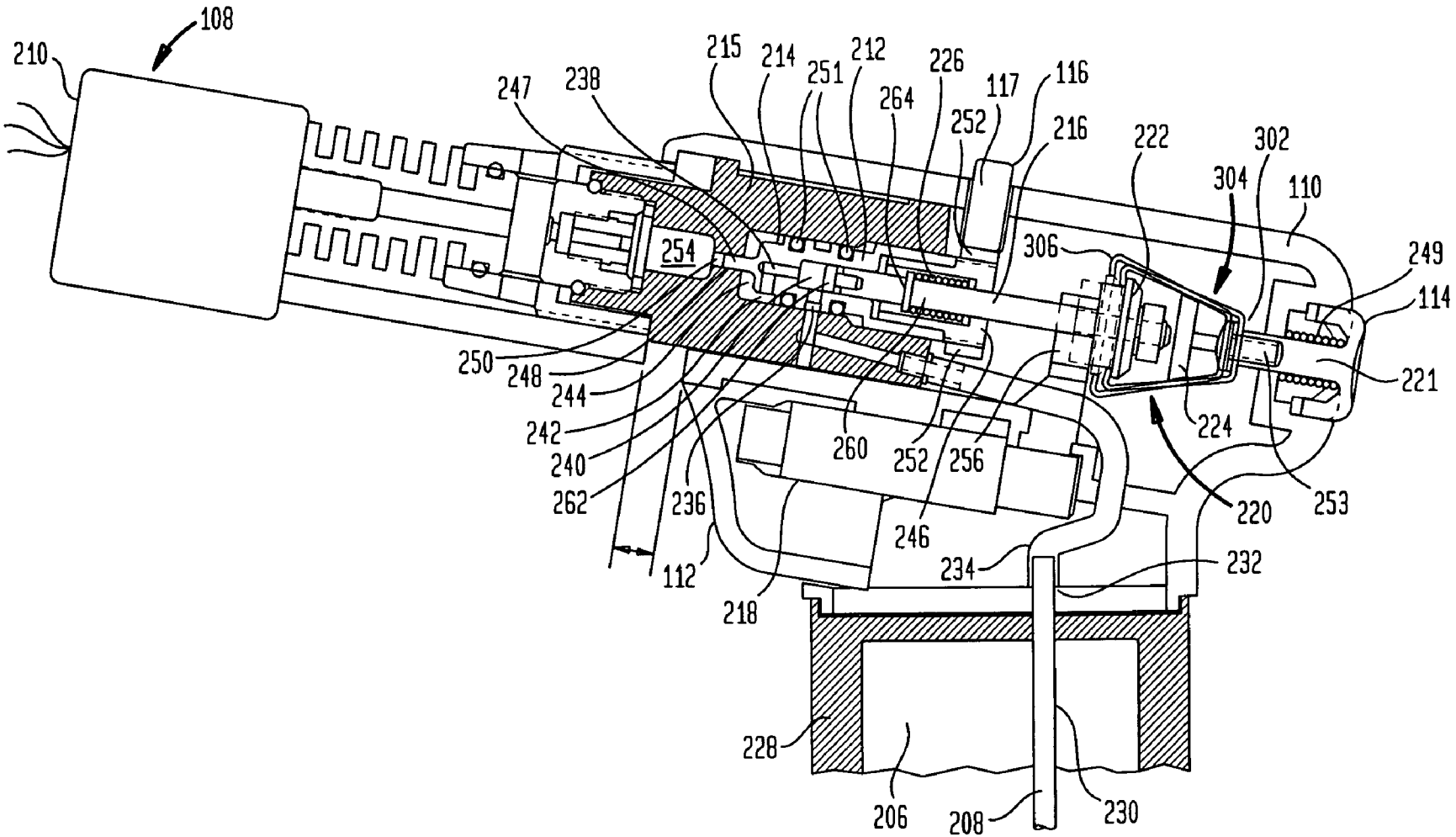

FIGS. 2A and 2B are cutaway partial side-views of the torch 100 shown in FIG. 1. In FIG. 2A, the torch assembly 106 is off (i.e., it is not producing a flame). In FIG. 2B, the torch assembly 106 is on (i.e., it is producing a flame) and is moving into a continuous-flame mode. Functionally, the illustrated torch 100 includes a flame initiating assembly 202 and a continuous-flame mode assembly 204.

The flame initiating assembly 202 includes a fuel storage compartment 206, a fuel flow path 208 that extends from the fuel storage compartment 206 to an outlet 210 of the torch's nozzle 108, a valve 212 that controls fuel flow through the fuel flow path 208 and the trigger 112 that is adapted for manipulation by a user to establish fuel flow through the fuel flow path 208 and to ignite a flame at the outlet 210 of the nozzle 108. The valve 212 includes a valve body 214 and a plunger 216 that can move through the valve body 214 to control fuel flow through the valve 212 and, therefore, through the fuel flow path 208. The valve body 214 is positioned within a valve nest 215. The valve nest 215 is positioned within the housing 110. The trigger 112 is adapted to move the plunger 216. The flame initiating assembly 202 also includes an optional flame adjuster lever 117 operatively coupled to the valve body 214 in such a manner that movement of the lever 117 causes the valve body 214 to move through the valve nest 215 in the housing 110 and, thereby, adjusts the rate at which fuel can flow through the fuel flow path 208. The flame initiating assembly 202 also includes an igniter 218 operatively coupled to the trigger 112 and adapted to produce an ignition spark in response to a user squeezing the trigger 112. In a preferred embodiment, the igniter 218 is a piezoelectric element, in which the motion of the trigger 112 causes a spring-loaded hammer to strike a piezoelectric crystal, thereby producing a voltage and resulting in a spark to ignite the fuel.

The continuous-flame mode assembly 204 includes a continuous-flame mode actuator in the form of a spring-loaded button 114 that is exposed through the housing 110 for manipulation by a user to activate a continuous-flame mode, a latching element 220 coupled to the button 114, a continuous-flame mode engagement portion 222 coupled to the plunger 216 and adapted for engagement with the latching element 220 and a fixed element 224 secured to the housing 110 and positioned near the latching element 220. The latching element 220 is movable to engage the continuous-flame mode engagement portion 222 on the plunger 216 when the plunger 216 is in an open position (i.e., when the plunger 216 is positioned as shown in FIG. 2B). Once engaged, the latching element 220 prevents the plunger 216 from moving to a closed position (i.e., a position wherein the plunger 216 substantially blocks the fuel flow path 208).

To disengage the latching element 220 from the continuous-flame mode engagement portion 222 on the plunger 216 and, thereby deactivate the continuous-flame mode, the latching element 220 is adapted for movement in a manner that causes it to flex against the fixed element 224 and disengage the continuous-flame mode engagement portion 222 on the plunger 216. Once the latching element 220 disengages the continuous-flame mode engagement portion 222, the plunger 216 is free to move to the closed position (shown in FIG. 2A) and does so under force from plunger spring 226.

Figure 3:
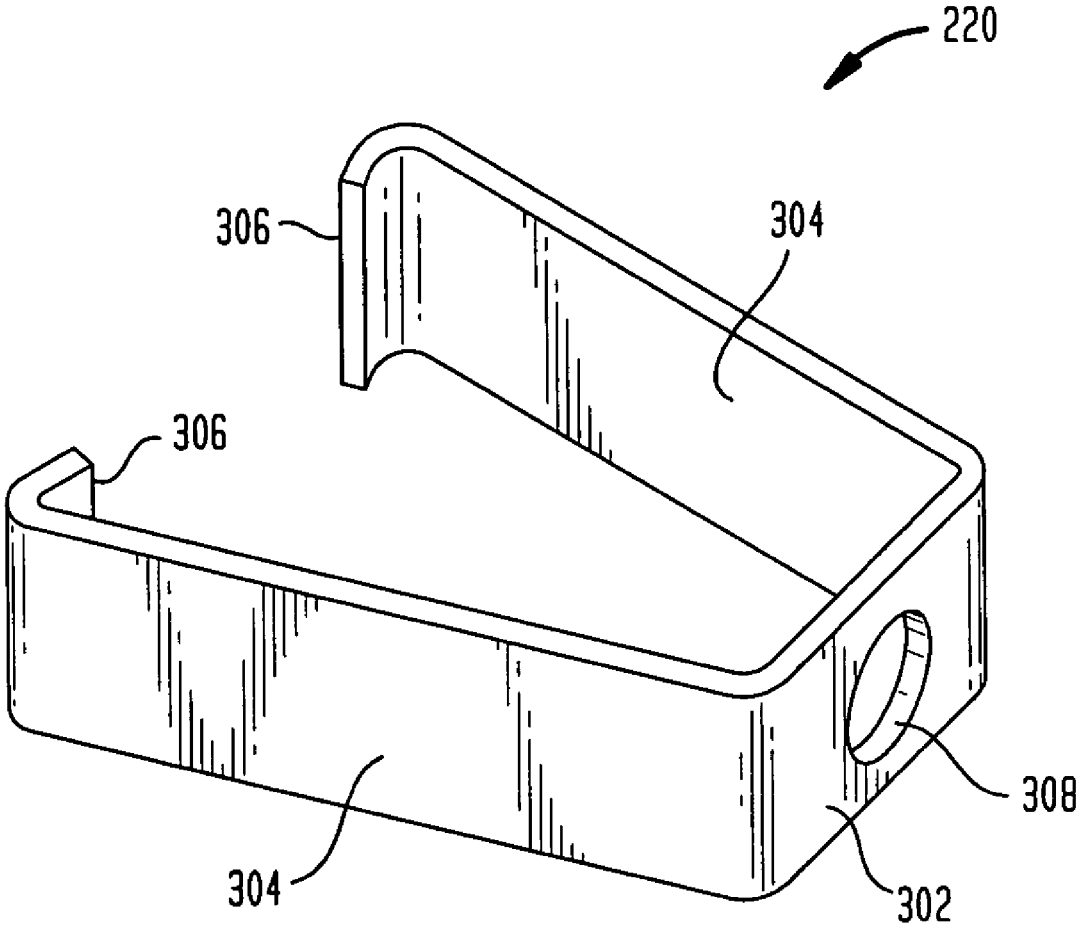
FIG. 3 is a perspective view of the latching element of FIGS. 2A and 2B.

FIG. 3 is a perspective view of the latching element 220 of FIGS. 2A and 2B.

The illustrated latching element 220 includes a substantially flat base 302. A pair of claws 304 extends from opposite sides of the base 302 in substantially the same direction, but angled slightly away from one another. Each claw 304 extends approximately an identical distance from the base 302. In the illustrated embodiment, the claws 304 are flexible. The distal ends 306 of the flexible claws 304 are bent inwardly so that the tips of the bent distal ends 306 face approximately towards each other. The base 302 includes a hole 308 for receiving a fastening element.

The claws 304 generally have some degree of flexibility, but also some degree of resilience, as well. In a typical implementation, the claws 304 should be flexible enough to flex outwardly to engage and to disengage a continuous-flame mode engagement portion (e.g., continuous-flame mode engagement portion 222) of a plunger. However, the claws 304 should be resilient enough to return to their original form after flexing in manners consistent with engaging and disengaging the engagement portion.

Turning again to FIGS. 2A and 2B, the pair of claws 304 extends from the base 302 of the latching element 220 substantially toward the plunger 216. Each claw 304 is angled slightly outward relative to the axis of the plunger 216. The button 114 has a stem 221 that passes through an opening 223 in the housing 110. The base 302 of the latching element 220 is coupled to the stem 221 with a fastening element 253 that passes through a hole (i.e., hole 308 in FIG. 3) in the base 302. As such, the latching element 220 and the button 114 are adapted to move together axially. Each claw 304 has a distal end 306 that is bent inwardly to facilitate gripping the continuous-flame mode engagement portion 222 on the plunger 216. A spring 249 is positioned between the housing 110 and the button 114 and is arranged to provide spring-loading for the button 114 in an outward direction.

As illustrated, the continuous-flame mode engagement portion 222 includes a lip 225 with a beveled surface 227 that is exposed for contact with the distal ends 306 of the latching element 220. The beveled surface 227 is formed so that the end of the beveled surface 227 closest to the button 114 has a smaller diameter than the end of the beveled surface 227 farthest from the button 114. A step is formed by the forward end of the lip 225 and the trigger engagement collar 258, which has a smaller diameter than the forward end of the lip 225. That step enables the continuous-flame mode engagement portion 222 to be gripped (as shown in FIG. 2B) by the distal ends 306 of the claws 304.

The fixed element 224 is coupled to the housing 110 and, therefore, is stationary with respect to the housing 110. The fixed element 224 extends between the claws 304 in such a manner that the fixed element 224 will contact the claws 304 when the claws 304 are moved forward from a position engaged to the continuous-flame mode engagement portion 222. The illustrated fixed element 224 has a pair of beveled surfaces 293, each of which is adapted to contact one of the claws 304.

The illustrated flame initiating assembly 202 includes a fuel storage compartment 206 adapted to store pressurized fuel therein. The fuel storage compartment 206 has a housing 228, a portion of which forms the torch's handle 104. The housing 228 is securely coupled to the torch assembly 106.

The fuel flow path 208 extends from the fuel storage compartment 206 to an outlet 210 of the torch's nozzle 108. In the illustrated embodiment, the fuel flow path 208 includes a fuel communication line 230 that provides for fluid communication between the pressurized fuel storage compartment 206 and the torch assembly 106. The illustrated fuel communication line 230 extends through the housing 228 of the fuel storage compartment 206 and mates with a fuel inlet port 232 on the torch assembly 106.

Within the torch assembly 106, a coupling tube 234 extends from the fuel inlet port 232 to the valve 212 and provides for fluid communication therebetween. The valve 212 is adapted to control the flow of fuel through the fuel flow path 208.

The illustrated valve 212 includes a valve body 214 and a plunger 216 that can move through the valve body 214 to control fuel flow through the valve 212 and, therefore, through the fuel flow path 208. The valve body 214 is positioned inside a valve nest 215 that is positioned within the housing 110. The valve body 214 forms portions of the fuel flow path 208 including a fuel inlet passage 236, a first cylindrical cavity 240, a second cylindrical cavity 238 and a fuel outlet passage 242. The illustrated valve body 214 also includes a rear cylindrical portion 245 that is securely fastened to a spring retention element 246. The outer surface of the rear cylindrical portion 245 has screw threads that engage a corresponding set of screw threads formed on an inner surface of the valve nest 215. In some implementations, the spring retention element 246 is press fit into the valve body 214 so that the spring retention element 246 and the valve body 214 can move axially together through the housing 110. Together, the rear cylindrical portion 245 and the spring retention element 246 contain a plunger spring 226.

The illustrated coupling tube 234 is in fluid communication with the valve's 212 fuel inlet passage 236, which extends radially inward through the valve body 214. A pair of o-rings 251 is provided between the valve body 214 and the valve nest 215 at opposite axial sides of the valve's 212 fuel inlet passage 236. Those o-rings 251 help prevent leakage from the fuel inlet passage 236 around the valve body 214. The o-rings 251 are coupled to grooves formed in an outer surface of the valve body 214 and are able to move axially through the valve nest 215 with the valve body 214.

The first cylindrical cavity 240 extends axially through the valve body 214 from the fuel inlet passage 236 to the second cylindrical cavity 238. The plunger 216 is adapted to move axially through the first cylindrical cavity 240. Fuel flow through the valve body 214 depends on the plunger's 216 position within the first cylindrical cavity 240. In one position (e.g., the position shown in FIG. 2A), the plunger 216 blocks fuel flow from the first cylindrical cavity 240 to the second cylindrical cavity 238. In another position (e.g., the position shown in FIG. 2B), the plunger 216 allows fuel flow from the first cylindrical cavity 240 to the second cylindrical cavity 238.

The second cylindrical cavity 238 extends in an axial direction from the first cylindrical cavity 240 and is in fluid communication therewith. The second cylindrical cavity 238 has a narrower inner diameter than the first cylindrical cavity 240. The second cylindrical cavity 238 is too narrow to accommodate the plunger 216.

The fuel outlet passage 242 extends radially outward from the second cylindrical cavity 238 to a plenum 244, which also forms part of the fuel flow path 208. The plenum 244 is a space between the valve body 214 and the valve nest 215 and is near a forward end of the valve body 214.

The forward tip 247 of the valve body 214 forms a slightly tapered cylindrical extension 248 that extends at least partially into a corresponding slightly tapered cylindrical opening 250 in the valve nest 215 and is movable therein in an axial direction. The space provided between the cylindrical extension 248 and the slightly tapered cylindrical opening 250 forms part of the fuel flow path 208. The rate of fuel flow through that space depends on the amount of clearance that exists between the slightly tapered cylindrical extension 248 and the slightly tapered cylindrical opening 250. In general, a smaller clearance results in a lower fuel flow rate while a larger clearance results in a greater fuel flow rate. That clearance can be adjusted by moving the valve body 214 in an axial direction relative to the valve nest 215. In the illustrated embodiment, if the valve body 214 is moved forward relative to the valve nest 215, the clearance becomes smaller and the fuel flow rate is reduced. Alternately, if the valve body 214 is moved rearward relative to the valve nest 215, the clearance becomes larger and the fuel flow rate increases.

In the illustrated embodiment, the amount of clearance between the slightly tapered cylindrical extension 248 and the slightly tapered cylindrical opening 250 can be adjusted by manipulating the flame adjuster lever 117. The flame adjuster lever 117 is rigidly coupled to an annular flame adjuster interface 252 in such a manner that movement of the lever 117 causes the flame adjuster interface 252 to rotate about axis "b". The flame adjuster interface 252 has an axial, serrated opening that receives the spring retention element 246. The serrations on the inner surface of the flame adjuster interface 252 engage corresponding serrations on an outer surface of the spring retention element 246. Accordingly, rotation of the flame adjuster interface 252 causes similar rotation of the spring retention element 246. Since the spring retention element 246 is rigidly coupled to the valve body 214 (e.g., by a press fit), the valve body 214 also rotates with the spring retention element. The rear cylindrical portion 245 of the valve body 214 is screwed into the valve nest 215. Therefore, the valve body moves axially relative to the valve nest 215 as it rotates. Since the spring retention element 246 is rigidly coupled to the valve body 214, the spring retention element also moves axially relative to the valve nest 215. As discussed herein, moving the valve body 214 axially through the valve nest 215 changes the intensity of the flame being produced at the outlet 210 of nozzle 108.

The illustrated fuel flow path 208 continues from the space between the slightly tapered cylindrical extension 248 at the forward tip 247 of the valve body 214 and the slightly tapered cylindrical opening 250 in the valve nest 215 to a compartment 254 that feeds into the nozzle 108. The fuel flow path 208 continues through the nozzle 108 to the outlet 210 of the nozzle 108.

The flame initiating assembly 202 also includes the trigger 112 that is operable to create a flame at the outlet 210 of nozzle 108. The flame is created by establishing fuel flow through the fuel flow path 208 and by igniting the flowing fuel.

Actuation of the trigger 112 initiates fuel flow by moving the plunger 216 to a position (FIG. 2B) that allows fuel to flow through the fuel flow path 208. The trigger 112 is able to accomplish that because it is coupled to the plunger 216 by virtue of coupling element 256. The illustrated coupling element 256 extends from the trigger 112 to the plunger 216 and has an opening, through which the plunger 216 passes and through which the plunger 216 can freely move in an axial direction. In some embodiments, the opening is a cylindrical passage through the coupling element 256. In other implementations, the opening is a U-shaped cutout in the coupling element 256. The opening can be any other convenient shape or configuration.

The coupling element 256 is adapted to move with the trigger 112, so that when a user squeezes the trigger 112, the coupling element 256 moves toward a trigger engagement collar 258 that is securely coupled to a rear portion of the plunger 216. The trigger engagement collar 258 is positioned relative to the coupling element 256 such that, when the trigger 112 is fully squeezed, the coupling element 256 contacts the trigger engagement collar 258 and causes the trigger engagement collar 258 (and, therefore, the plunger 216) to move axially rearward an amount sufficient to at least partially establish fuel flow from the first cylindrical cavity 240 of the valve 212 to the second cylindrical cavity 238.

The flame initiating assembly 202 also includes the plunger 216, which has a shaft 260, a rubber seal 262 coupled to a forward end of the shaft 260, a collar 264 for mating with plunger spring 226 to spring-load the plunger 216. The coupling element 256 is operatively coupled to the shaft 260. The continuous-flame mode engagement portion 222 is coupled to the shaft 260 at a rear end thereof. Fastening elements 266 hold the trigger engagement collar 258 and the continuous-flame mode engagement portion 222 in place. The illustrated fastening elements include a nut 268 and a lock washer 271. However, other fastening elements could be used as well.

The illustrated embodiment shows the continuous-flame mode engagement portion 222 and the trigger engagement collar 258 formed as a distinct piece that is fit over the end of the plunger shaft 260. However, in other embodiments, the continuous-flame mode engagement portion and trigger engagement collar 258 are integrally formed (e.g., by integral casting, welding, etc.) with the plunger shaft 260. The illustrated continuous-flame mode engagement portion 222 and trigger engagement collar 258 have openings that extend in an axial direction, through which the plunger shaft 260 passes in an axial direction.

Operationally, squeezing the trigger 112 results in initiating a flame at the outlet 210 of the nozzle. Once initiated, the flame can be maintained by keeping the trigger 112 squeezed. However, if the trigger 112 is released without activating the continuous-flame mode, the flame is extinguished. If, the button 114 is pressed and released while a flame is being produced, then the torch enters the continuous-flame mode and the flame will be maintained even if the trigger 112 is subsequently released. If the torch is operating in continuous-flame mode, that mode can be deactivated by pressing and releasing the button 114 again. Deactivation of the continuous-flame mode extinguishes the flame. Each of those operating modes is discussed in more detail below.

When the trigger 112 is squeezed, the trigger 112 moves from the position shown in FIG. 2A to the position shown in FIG. 2B. When the trigger 112 moves in that manner, the coupling element 256 also moves. More particularly, the coupling element 256 moves axially rearward to contact the trigger engagement collar 258 on the plunger 216. Once contact is established, further rearward movement of the coupling element 256 causes the trigger engagement collar 258 and the plunger 216 to move axially rearward in the torch assembly 106. Eventually, the plunger 216 moves a sufficient amount to unblock the fuel inlet passage 236 of the valve 212 and allow fuel to begin flowing through the fuel flow path 208.

Squeezing the trigger 112 to move it from the position shown in FIG. 2A to the position shown in FIG. 2B also causes the igniter 218 to create an ignition spark. That ignition spark ignites the fuel that is flowing through the outlet 210 of the nozzle 108.

Once a flame is established at the outlet 210 of the nozzle 108, if the trigger 112 is held in a squeezed position (FIG. 2B), then the coupling element 256 keeps the plunger 216 in an open position (FIG. 2B) allowing fuel flow through the fuel flow path 208. Accordingly, a flame is maintained at the outlet 210. However, if continuous-flame mode has not been activated and the trigger 112 is released, the trigger 112 and the plunger 216 return to their respective positions shown in FIG. 2A. The plunger 216 moves under force from plunger spring 226 and the trigger 112 moves under force from a trigger spring (not shown in the illustrated embodiment). The plunger 216, therefore, terminates fuel flow through the fuel flow path 208 by blocking the second cylindrical cavity 238 of the valve 212.

If the button 114 is pressed when the plunger 216 is in an open position (FIG. 2B), the latching element 220 moves toward the continuous-flame mode engagement portion 222 on the plunger 216. Eventually, the distal ends 306 of the flexible claws 304 contact a portion of the beveled surface 227. Once that contact is established, further movement of the flexible claws 304 in the same direction causes the distal ends 306 to move along the beveled surface 227 to portions thereof having an increasingly larger diameter. To accommodate the increasing diameter of the beveled surface 227, the flexible claws 304 flex outwardly. Once the flexible claws 304 move forward an amount that is sufficient to allow the distal ends to flex past the step formed by the forward end of the lip 225 and the trigger engagement collar 258, the flexible claws 304 flex inwardly, thereby gripping and engaging the continuous-flame mode engagement portion 222 and placing the torch assembly 106 into a continuous-flame operating mode.

Once the continuous-flame operating mode has been activated, the trigger 112 can be released without extinguishing the flame at the outlet 210. That is because the flexible claws 304 of the latching element 220 hold the plunger 216 in the open position (FIG. 2B).

To deactivate the continuous-flame mode, the flexible claws 304 can be disengaged from the continuous-flame mode engagement portion 222. To accomplish that, a user can once again press the button 114. That causes the flexible claws 304 to move axially forward and, eventually, contact the fixed element 224. Once contact is established, further movement of the flexible claws in the same direction causes the flexible claws 304 to flex outwardly to a point where the distal ends 306 of the flexible claws 304 clear the widest section (i.e., the step) of the continuous-flame mode engagement portion 222. Once the widest section is cleared, the plunger 216 is free to move under the force from plunger spring 226 to a closed position (FIG. 2A) preventing fuel flow through the fuel flow path 208 and extinguishing the flame.

The flame adjuster lever 117 can be moved anytime to adjust the rate of fuel flow that can pass through the fuel flow path 208. Rate of fuel flow determines the intensity of the flame that can be created at the outlet 210. Moving the flame adjuster lever 117 adjusts the clearance between the slightly tapered cylindrical extension 248 and the corresponding slightly tapered cylindrical opening 250 in the valve nest 215. More particularly, moving the flame adjuster lever 117 causes the valve body 214 to move axially through the valve nest 215. Moving the valve body 214 rearward (i.e., toward the button 114) increases the clearance between the slightly tapered cylindrical extension 248 and the corresponding slightly tapered cylindrical opening 250 and, therefore, increases the intensity of the flame that can be produced. Conversely, moving the valve body 214 forward (i.e., toward the nozzle 108) increases the clearance between the slightly tapered cylindrical extension 248 and the corresponding slightly tapered cylindrical opening 250 and, therefore, decreases the intensity of the flame that can be produced.

In some embodiments, the trigger 112 is child-resistant. That child resistance can be achieved by virtue of a spring (not visible in FIGS. 2A and 2B, but see 404 in FIG. 4) coupled to the trigger 112 in a manner that makes the torch 100 resist successful operation by young children. In a typical embodiment, the spring would be adapted to require at least eight pounds of force to operate the trigger 112. More preferably, the spring would be adapted to require at least ten pounds of force to operate the trigger 112. Other methods of making the trigger 112 child-resistant are possible.

Figure 4:
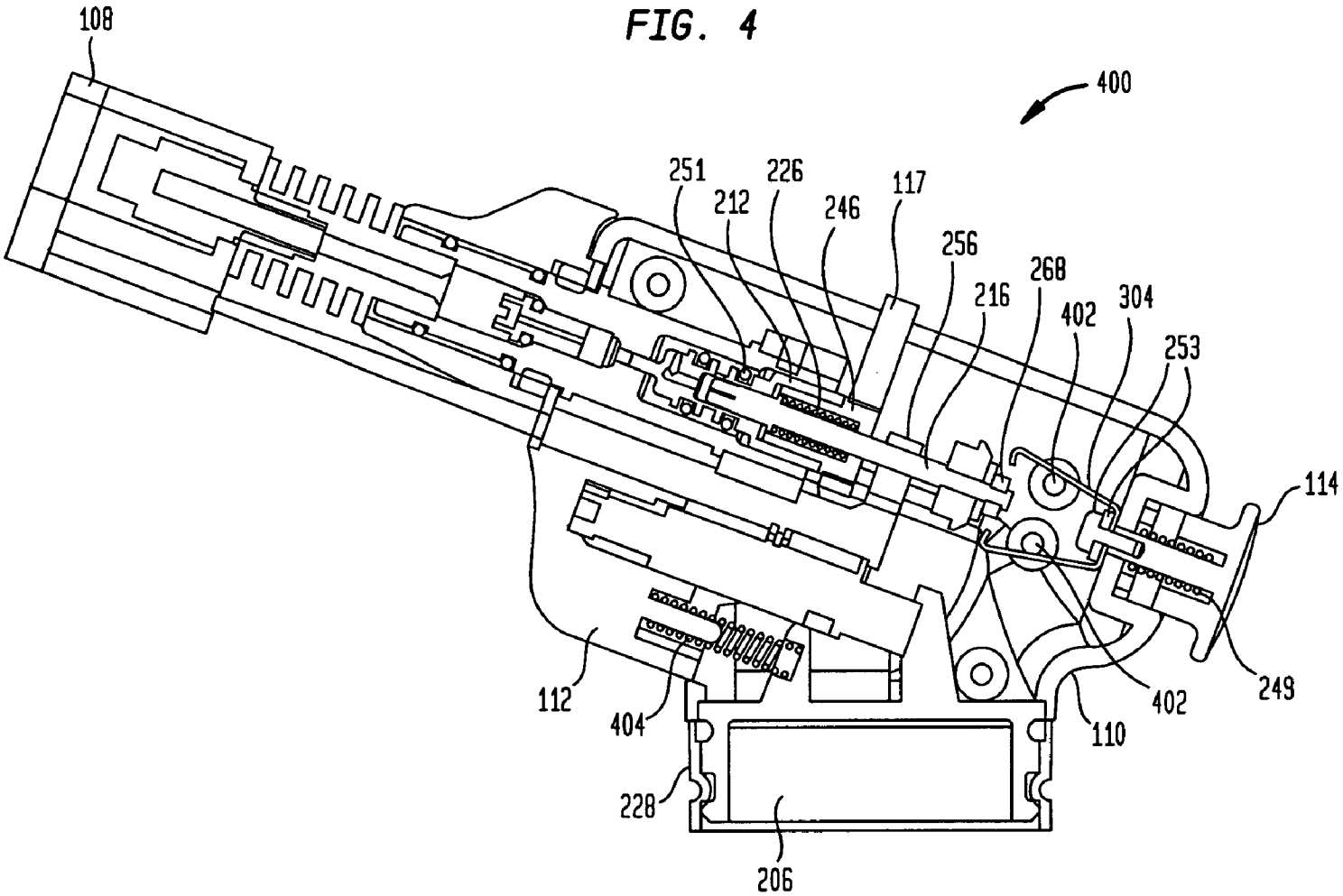
FIG. 4 is a cutaway partial side-view of an alternative embodiment of a hand-held torch that is capable of being operated in a continuous-flame mode.

FIG. 4 is a cutaway partial side-view of an alternative embodiment of a hand-held torch 400 that is capable of being operated in a continuous-flame mode.

The embodiment of FIG. 4 is very similar to the embodiment discussed above in connection with FIGS. 2A and 2B. However, the fixed element in FIG. 4 is a pair of pins 402 that extend from the lighter's housing 110. The pins 402 are positioned so that the flexible claws 304 can contact them to disengage from the continuous-flame mode engagement portion 222.

Also, the embodiment of FIG. 4 shows a spring 404 coupled to the trigger 112 in a manner that causes the trigger 112 to resist successful operation by a young child. In some embodiments, the spring 404 spring loads the trigger 112 so that successful operation requires application of at least eight pounds of force. In other embodiments, the spring 404 spring loads the trigger 112 so that successful operation requires application of at least ten pounds of force. More generally, the spring 404 is adapted to require applications of force that will render the trigger child-resistant, in accordance with applicable regulations.

Figure 5A:
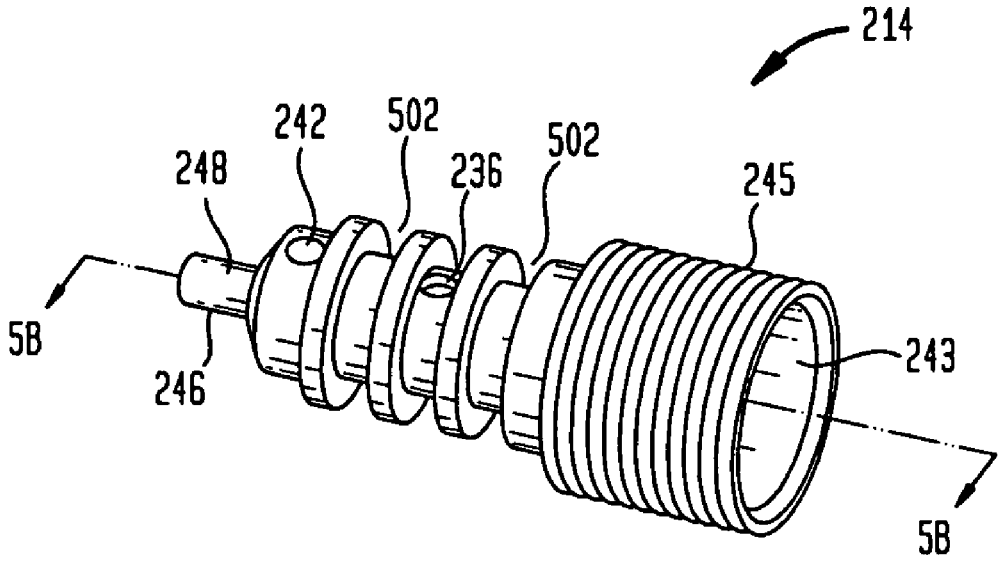
FIG. 5A is a perspective view of the valve body of FIGS. 2A and 2B.
Figure 5B:
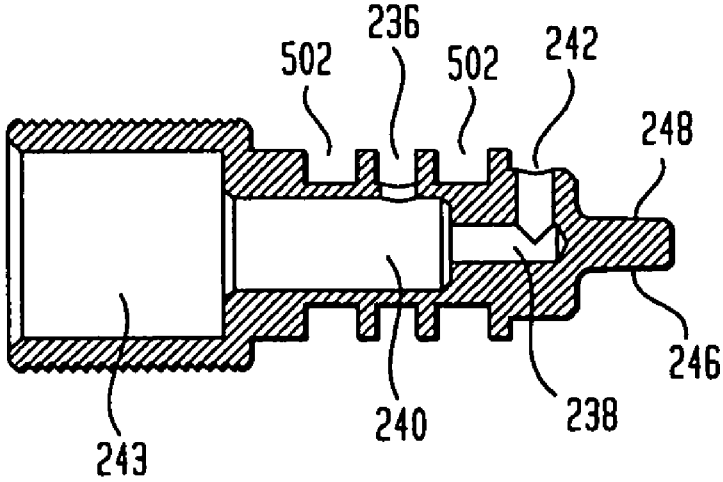
FIG. 5B is a cutaway side view of the valve body of FIGS. 2A and 2B.

FIG. 5A is a perspective view of the valve body 214 of FIGS. 2A and 2B. FIG. 5B is a cutaway side view of the valve body 214.

The valve body 214 includes a fuel inlet passage 236 that extends radially through the valve body 214 and opens into a first cylindrical cavity 240. A second cylindrical cavity 238 with a narrower diameter than the first cylindrical cavity 240 is connected to and axially aligned with the first cylindrical cavity 240. A fuel outlet passage 242 extends from the second cylindrical cavity 238 radially outward through the valve body 214. A rear cylindrical portion 245 also is connected to and axially aligned with the first cylindrical cavity 240. The rear cylindrical portion 245 extends from the first cylindrical cavity 240 in a direction that is opposite the second cylindrical cavity 238. The rear cylindrical portion forms a cavity 243 that has a larger diameter than both the first and second cylindrical cavities 240, 238. The outer surface of the rear cylindrical portion 245 is threaded.

A pair of grooves 502 is formed in an outer surface of the valve body 214. Those grooves 502 are adapted to receive o-rings (i.e., o-rings 251 in FIGS. 2A and 2B). The forward tip 247 of the valve body 214 forms a slightly tapered cylindrical extension 248.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

For example, the latching element could be adapted to engage the plunger in a variety of different ways, for example, by using a tab to engage a slot, by utilizing other gripping means, etc. Additionally, other techniques may be used to prevent and/or allow fuel flow through the torch. For example, any number of simple valve configurations could be used. A variety of materials can be used to manufacture the structures disclosed herein, and a variety of methods can be utilized to secure those structures to each other.

Although specific actuating mechanisms have been described, there are a variety of suitable actuating mechanisms, e.g., switches, knobs, buttons, etc. that might be used instead of those specifically disclosed herein. Other techniques for igniting the fuel are possible and a variety of fuel types are possible.

Additionally, although two claws are shown, any number of claws (including only one) may be suitable for a particular embodiment. Moreover, the claws can be formed from flexible wires, tubes or other configurations. The claws can be metallic, plastic or any suitable material. Moreover, the latching element may be a claw formed from two or more pieces connected together. Forming the latching element as two or more smaller pieces might be desirable to minimize deformation of the latching element during heat treatment or other processing steps. That may be desirable since the dimensions and the angle of the latching element is very important to ensure that the torch operates optimally.

In some implementations, the torch housing 110 is split (i.e., it consists of two halves that are connected together after the torch internals have been assembled). The torch housing 110 may be formed in a number of other ways as well.

Moreover, the techniques and structures disclosed herein may be readily adapted to a variety of lighter and torch applications.

Accordingly, other embodiments are within the scope of the following claims.

What is claimed is:

1. A hand-held torch comprising:

a housing;

a fuel flow path;

a plunger having open and closed positions and an engagement portion, said plunger moveable between said open and closed positions to permit fuel flow selectively through the fuel flow path in said open position, said plunger being biased in said closed position;

a latching element having a restraint portion which receives and restrains said engagement portion; and a continuous-flame mode actuator exposed for manipulation by a user having engaged and disengaged positions, which, upon manipulation by said user, engages said latching element in said engaged position to allow said latching element to selectively grip and restrain said engagement portion of said plunger in said open position absent continued manipulation by said user.

2. The hand-held torch of claim 1 wherein the latching element prevents the plunger from moving into a position to block the fuel flow path.

3. The hand-held torch of claim 1 wherein the latching element comprises one or more claws.

4. The hand-held torch of claim 3 wherein the one or more claws are flexible.

5. The hand-held torch of claim 3 wherein each claw comprises a distal end that is angled to grip the engagement portion.

6. The hand-held torch of claim 5 wherein the engagement portion further comprises:

a beveled surface exposed for contact with the one or more claws when the one or more claws are moved toward the engagement portion for engagement therewith; and an indent formed at an end of the beveled surface opposite the one or more claws, wherein the one or more claws engage the engagement portion by:

contacting the beveled surface;

moving along the beveled surface in a manner that causes the one or more claws to flex;

subsequently, moving past the beveled surface to the indent; and flexing so that the distal ends engage the indent.

7. The hand-held torch of claim 1 further comprising:

a fixed element coupled to the housing and positioned adjacent to the latching element, such that, when the latching element is in engagement with the engagement portion and the actuator is manipulated, the latching element contacts the fixed element and, thereby, flexes to disengage from the engagement portion.

8. The hand-held torch of claim 7 wherein the fixed element comprises at least one pin that extends from the housing.

9. The hand-held torch of claim 1 further comprising a child-resistant flame actuator coupled to the housing and exposed for manipulation by a user.

10. The hand-held torch of claim 9 wherein the child-resistant flame actuator comprises:

a trigger coupled to the housing; and a spring coupled to trigger and arranged to resist actuation of the trigger.

11. The hand-held torch of claim 1 wherein the continuous-flame mode actuator comprises a button that can be moved in a direction that is in line with an axis of the plunger.

12. The hand-held torch of claim 11 wherein the button is spring loaded.

13. A method of operating a hand-held, continuous-flame mode torch, the method comprising:

moving a plunger having an engagement portion to an open position to permit fuel flow selectively through a fuel flow path;

igniting the flowing fuel to create a flame at an outlet of the fuel flow path; and with the plunger in said open position, applying a force to a latching mechanism, moving said latching mechanism into an engaged position which selectively grips and restrains said engagement portion of said plunger in an open position after said force has been disengaged.

14. The method of claim 13 further comprising: using the latching mechanism to prevent the plunger from moving to a closed position blocking the fuel flow path.

15. The method of claim 13 wherein the latching mechanism comprises one or more claws adapted to engage an engagement portion on the plunger.

16. The method of claim 15 wherein the one or more claws are flexible, flex in a manner that facilitates their engagement with the engagement lip.

17. The method of claim 13 further comprising disengaging the latching element from the engagement portion on the plunger.

18. The method of claim 16 further comprising flexing the one or more flexible claws in a manner that facilitate their disengagement from the plunger.

19. The method of claim 18 wherein the one or more claws contact a fixed element and flex in response to the contact.

20. The hand-held torch of claim 9 wherein the child resistant flame actuator moves said plunger between a closed position substantially blocking the fuel flow path and an open position substantially allowing fuel flow through the fuel flow path.

21. A hand-held torch comprising:

a housing;

a fuel flow path defined within said housing;

a plunger moveable within said housing to control fuel flow through the fuel flow path;

an engagement portion coupled to said plunger;

a latching element comprising a base and at least two opposing claws moveable relative to each other, the latching element being moveable to engage the engagement portion when the plunger is in a position allowing fuel flow through the fuel flow path, the latching element engaging the engagement portion by movement of said claws relative to each other; and a continuous-flame mode actuator coupled to the latching element and exposed for manipulation by a user to move said claws into engagement with the engagement portion.

22. The hand-held torch of claim 21 wherein the one or more claws are flexible.

23. The hand-held torch of claim 21 wherein each claw comprises a distal end that is angled to grip the engagement portion.

24. The hand-held torch of claim 23 wherein the engagement portion further comprises:

a beveled surface exposed for contact with the one or more claws when the one or more claws are moved toward the engagement portion for engagement therewith; and an indent formed at an end of the beveled surface opposite the one or more claws, wherein the one or more claws engage the engagement portion by:

contacting the beveled surface in a manner that causes the one or more claws to flex;

moving along the beveled surface in a manner that causes the one or more claws to flex;

subsequently, moving past the beveled surface to the indent; and flexing inwardly so that the distal ends engage the indent.

25. A hand-held torch comprising:

a housing;

a fuel flow path defined within said housing;

a plunger moveable within said housing to control flow through the fuel flow path;

an engagement portion coupled to said plunger;

a latching element moveable to engage the engagement portion when the plunger is in a position allowing fuel flow through the fuel flow path;

a continuous-flame mode actuator coupled to the latching element and exposed for manipulation by a user to move the latching element into engagement with the engagement portion; and a fixed element coupled to the housing and positioned to the latching element, such that, when the latching element is in engagement with the engagement portion and the actuator is manipulated, the latching element contacts the fixed element and, thereby, flexes to disengage from the engagement position.

26. The hand-held torch of claim 25 wherein the fixed element comprises at least one pin that extends from the housing.

27. The hand-held torch of claim 1, wherein said plunger further comprises a longitudinal axis and wherein the continuous-flame made actuator further comprises a button moveable in a direction that is in line with said longitudinal axis.

28. The hand-held torch of claim 27 wherein the button is spring loaded.

29. A hand-held torch comprising:

a housing;

a fuel flow path; a plunger having open and closed positions and an engagement portion, said plunger moveable between said open and closed positions to permit fuel flow selectively through the fuel flow path in said open position, said plunger being biased in said closed position;

a latching element having a restraint portion which receives and restrains said engagement portion; and a continuous-flame mode actuator exposed for manipulation by a user having engaged and disengaged positions, which, upon manipulation by said user, engages said latching element in said engaged position to allow said latching element to selectively receive and restrain said engagement portion of said plunger in said open position absent continued manipulation by said user;

wherein the latching element comprises one or more claws;

wherein each claw comprises a distal end that is angled to grip the engagement portion;

wherein said engagement portion further comprises:

a beveled surface exposed for contact with the one or more claws when the one or more claws are moved toward the engagement portion for engagement therewith; and an indent formed at an end of the beveled surface opposite the one or more claws, wherein the one or more claws engage the engagement portion by: contacting the beveled surface;

moving along the beveled surface in a manner that causes the one or more claws to flex;

subsequently, moving past the beveled surface to the indent; and flexing so that the distal ends engage the indent.

30. A hand-held torch comprising:

a housing;

a fuel flow path;

a plunger having open and closed positions and an engagement portion, said plunger moveable between said open and closed positions to permit fuel flow selectively through the fuel flow path in said open position, said plunger being biased in said closed position;

a latching element having a restraint portion which receives and restrains said engagement portion;

a continuous-flame mode actuator exposed for manipulation by a user having engaged and disengaged positions, which, upon manipulation by said user, engages said latching element in said engaged position to allow said latching element to selectively receive and restrain said engagement portion of said plunger in said open position absent continued manipulation by said user; and a fixed element coupled to the housing and positioned adjacent to the latching element, such that, when the latching element is in engagement with the engagement portion and the actuator is manipulated, the latching element contacts the fixed element and, thereby, flexes to disengage from the engagement portion.

31. The hand-held torch of claim 30 wherein the fixed element comprises at least one pin that extends from the housing.

32. The hand-held torch of claim 1, whereby movement of said plunger from said closed position to said open position provides continuous flow of said fuel through said fuel flow path.

33. A hand-held torch comprising:

a housing;

a fuel flow path;

a plunger having open and closed positions and an engagement portion, said plunger moveable between said open and closed positions to permit fuel flow selectively through the fuel flow path in said open position, said plunger being biased in said closed position;

a latching element having a restraint portion which receives and restrains said engagement portion; and a continuous-flame mode actuator exposed for manipulation by a user having engaged and disengaged positions, which, upon manipulation by said user, engages said latching element in said engaged position to allow said latching element to selectively receive and restrain said engagement portion of said plunger in said open position absent continued manipulation by said user;

wherein said plunger further comprises a longitudinal axis and wherein the continuous-flame made actuator further comprises a button moveable in a direction that is in line with said longitudinal axis and said button is spring loaded.

* * * * *